US009083080B2

(12) United States Patent
Chen et al.

(10) Patent No.: US 9,083,080 B2
(45) Date of Patent: Jul. 14, 2015

(54) PORTABLE ELECTRONIC DEVICE AND ANTENNA STRUCTURE THEREOF

(71) Applicant: Wistron NeWeb Corp., Hsinchu (TW)

(72) Inventors: Chung-Hung Chen, Hsinchu (TW); Yi-Hung Chiu, Hsinchu (TW); Chia-Hao Chang, Hsinchu (TW); Chih-Sen Hsieh, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 205 days.

(21) Appl. No.: 13/954,216

(22) Filed: Jul. 30, 2013

(65) Prior Publication Data

US 2014/0104134 A1 Apr. 17, 2014

(30) Foreign Application Priority Data

Oct. 12, 2012 (TW) ..... 101137609 A

(51) Int. Cl.

| | |
|---|---|
| ***H01Q 1/50*** | (2006.01) |
| ***H01Q 1/24*** | (2006.01) |
| ***H01Q 9/14*** | (2006.01) |
| ***H01Q 9/42*** | (2006.01) |
| ***H01Q 5/40*** | (2015.01) |

(52) U.S. Cl.

CPC ..... *H01Q 1/50* (2013.01); *H01Q 1/243* (2013.01); *H01Q 5/40* (2015.01); *H01Q 9/145* (2013.01); *H01Q 9/42* (2013.01)

(58) Field of Classification Search

CPC ..... H01Q 1/243; H01Q 1/50; H01Q 9/42
USPC ..... 343/700 MS, 702, 725, 729, 853, 876
See application file for complete search history.

(56) References Cited

U.S. PATENT DOCUMENTS

| | | | | |
|---|---|---|---|---|
| 5,420,599 | A * | 5/1995 | Erkocevic | 343/828 |
| 6,819,290 | B2 * | 11/2004 | Hani et al. | 343/700 MS |
| 6,876,329 | B2 * | 4/2005 | Milosavljevic | 343/700 MS |
| 7,808,433 | B2 * | 10/2010 | Rutfors et al. | 343/700 MS |
| 7,808,445 | B2 * | 10/2010 | von Arbin | 343/876 |
| 8,866,683 | B2 * | 10/2014 | Wong et al. | 343/745 |

* cited by examiner

*Primary Examiner* — Tho G Phan
(74) *Attorney, Agent, or Firm* — Muncy, Geissler, Olds & Lowe, P.C.

(57) ABSTRACT

An antenna structure is provided, including a first radiator, a second radiator, a second coupling portion and a switch Circuit. The first radiator includes a feed portion and a first radiator body. The second radiator includes a first coupling portion, a second radiator body and a ground portion. The first coupling portion is connected to a first end portion of the second radiator body. The ground portion is connected to the second radiator body. At least a portion of the first radiator body is located between the first coupling portion and the second coupling portion. When the antenna structure is in a first mode, the switch circuit forms an electric path between the second radiator and the second coupling portion, and when the antenna structure is in a second mode, the switch circuit removes the electric path between the second radiator and the second coupling portion.

15 Claims, 5 Drawing Sheets

PORTABLE ELECTRONIC DEVICE AND ANTENNA STRUCTURE THEREOF

CROSS REFERENCE TO RELATED APPLICATIONS

This Application claims priority of Taiwan Patent Application No. 101137609, filed on Oct. 12 2012, the entirety of which is incorporated by reference herein.

BACKGROUND OF THE INVENTION

1. Field of the invention

The present invention relates to an antenna structure, and in particular, relates to an antenna structure with a changeable operation band.

2. Description of the Related Art

There are different operation bands, in different areas, for a single wireless communication standard. For example, in America, the operation band of the Long Term Evolution standard is between 704~960 MHz and 1710~2170 MHZ, and in Europe, the operation band of the Long Term Evolution standard is between 791~960 MHz and 1710~2170 MHZ. However, along with decreased dimensions of wireless communication devices, the dimensions of the antenna structure have been reduced, restricting the range of the bandwidth of the antenna structure. Particularly, the low frequency band portion of the antenna structure cannot simultaneously satisfy the transmission requirements of the American standard and the European standard.

BRIEF SUMMARY OF THE INVENTION

An antenna structure is provided. The antenna structure includes a first radiator, a second radiator, a second coupling portion and a switch circuit. The first radiator includes a feed portion and a first radiator body. The second radiator includes a first coupling portion, a second radiator body and a ground portion, wherein the first coupling portion is connected to a first end portion of the second radiator body, and the ground portion is connected to the second radiator body. At least a portion of the first radiator body is located between the first coupling portion and the second coupling portion., The switch Circuit is connected to the second radiator and the second coupling portion, wherein when the antenna structure is in a first mode, the switch circuit forms an electric path between the second radiator and the second coupling portion, and when the antenna structure is in a second mode, the switch circuit removes the electric path between the second radiator and the second coupling portion.

The antenna structure of the embodiment of the invention is characteristic in that the operation band thereof shifts when the coupling degree between the first radiator, the second radiator and the second coupling portion is changed to satisfy transmission requirements. In the embodiment of the invention, the low-frequency bandwidth of the antenna structure is not increased by extending the total length of the antenna structure (particularly, is not increased by disposing an extending portion on a rear end of the antenna structure). The total length of the antenna structure of the embodiment of the invention is shorter, and still provides improved transmission.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
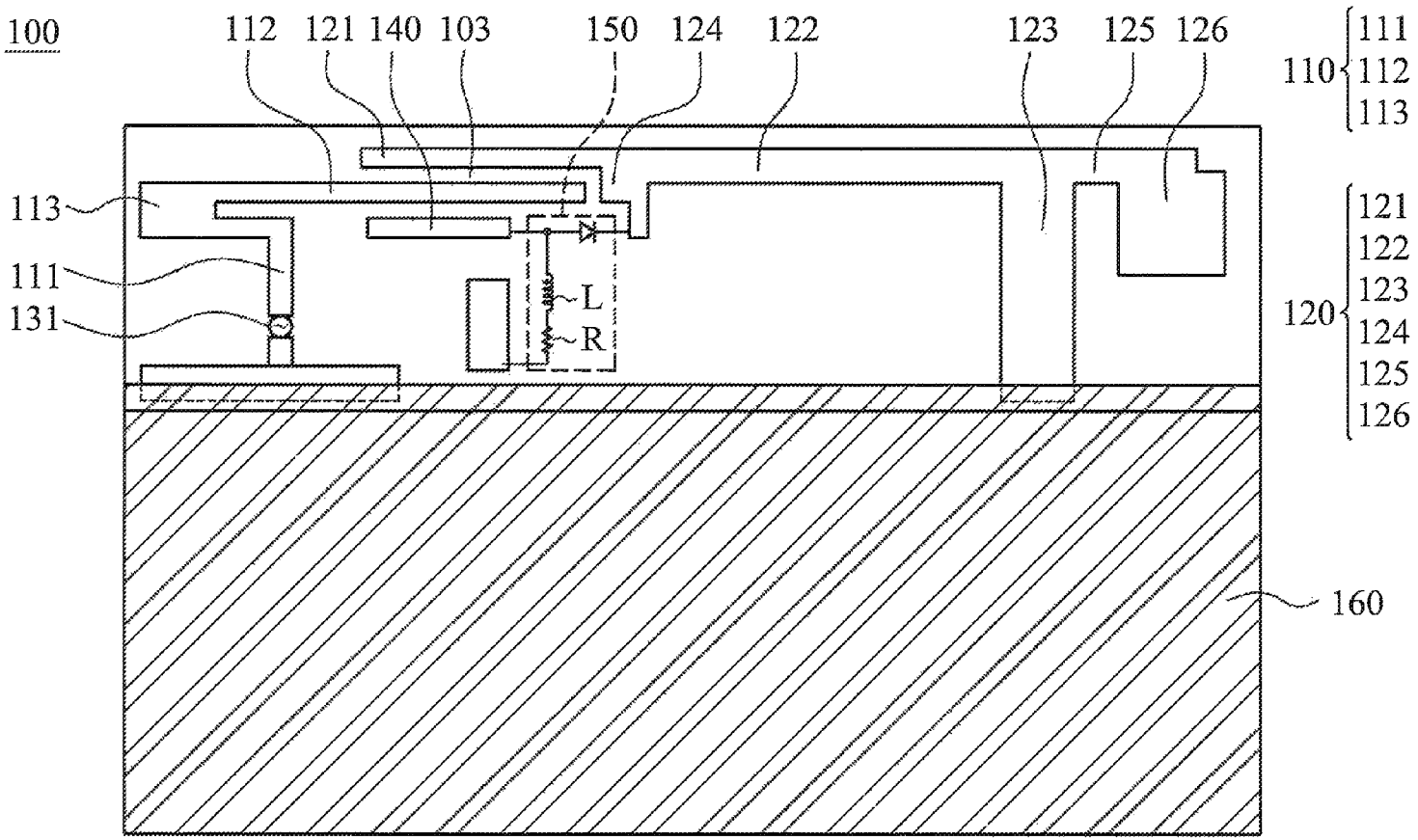
FIG. 1 shows the antenna structure of the embodiment of the invention.

The following description is of the best-contemplated mode of carrying out the invention, This description is made for the purpose of illustrating the general principles of the invention and should not be taken in a limiting sense. The scope of the invention is best determined by reference to the appended claims, FIG. 1 shows an antenna structure 100 of an embodiment of the invention, comprising a first radiator 110, a second radiator 120, a second coupling portion 140 and a switch circuit 150. The first radiator 110 comprises a feed portion 111 and a first radiator body 112. A feed source 131 is electrically connected to the feed portion 111. The second radiator 120 comprises a first coupling portion 121, a second radiator body 122 and a ground portion 121, wherein the first coupling portion 121 is connected to a first end portion 124 of the second radiator body 122, and the around portion 123 is connected to the second radiator body 122. At least a portion of the first radiator body 112 is located between the first coupling portion 121 and the second coupling portion 140. The switch circuit 150 is connected to the second radiator 120 and the second coupling portion 140.

The first radiator body 112 is parallel to the first coupling portion 121 and the second coupling portion 140. In this embodiment, the second coupling portion 140 is shorter than the first radiator body 112.

Figure 2A:
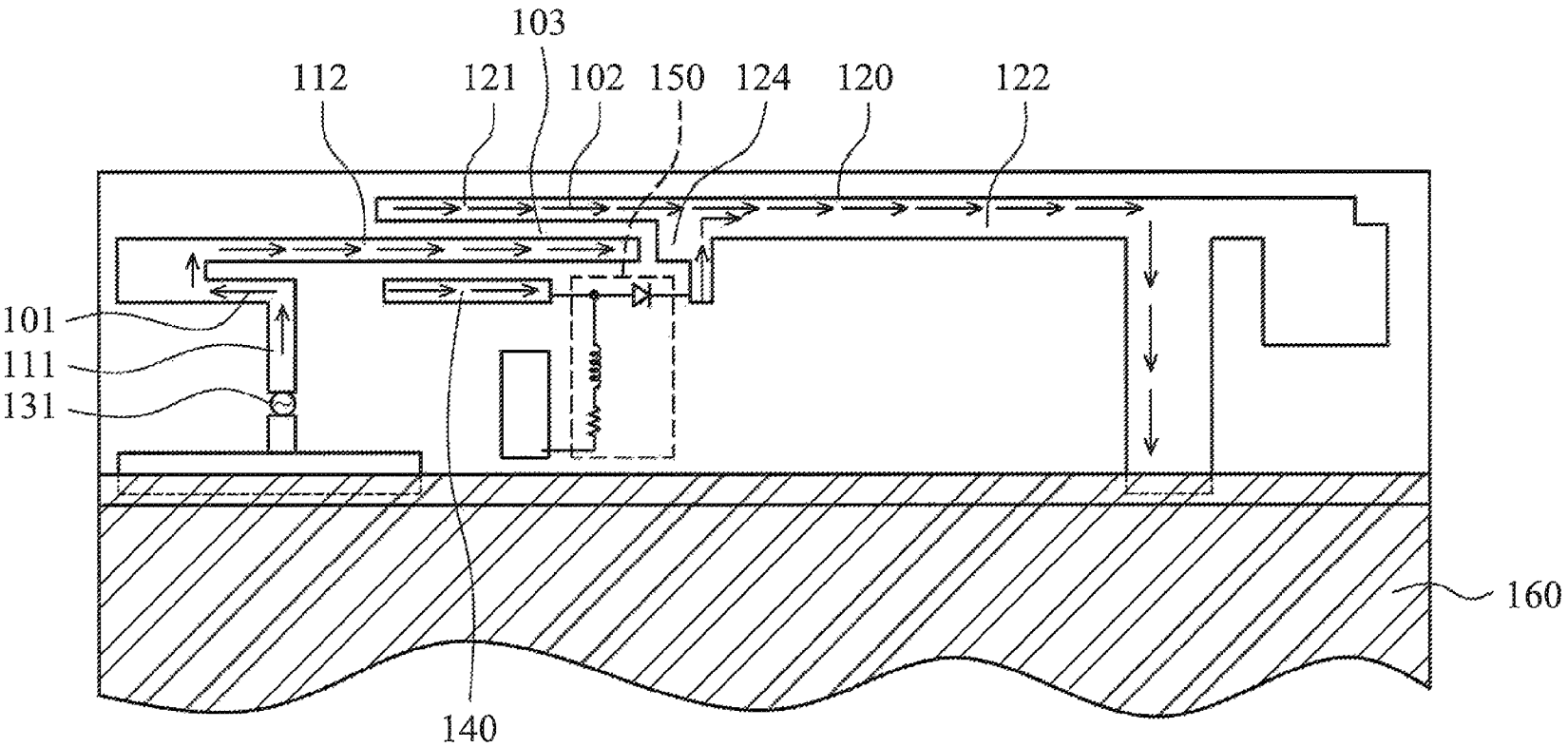
FIG. 2A shows the surface current distribution of the antenna structure of the embodiment of the invention in the first mode.
Figure 2B:
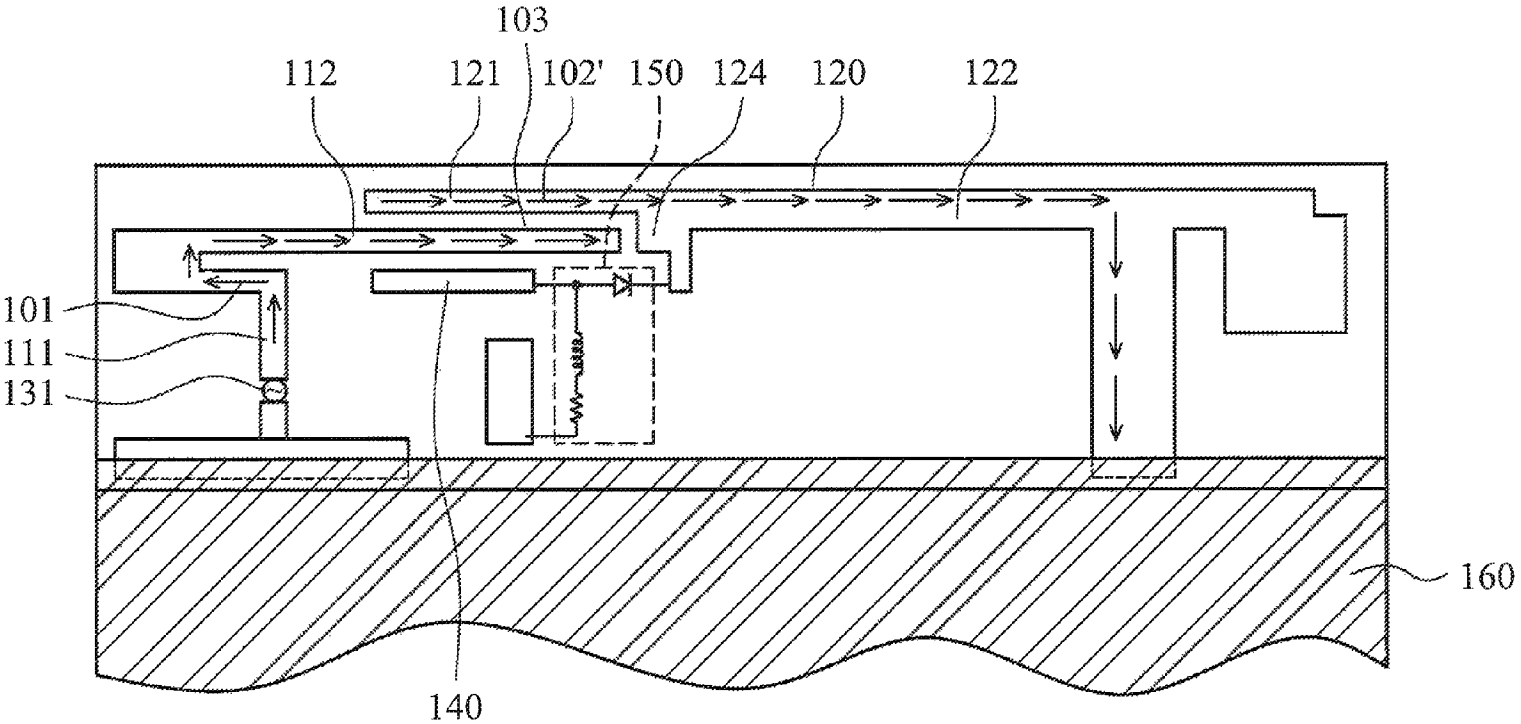
FIG. 2B shows the surface current distribution of the antenna structure of the embodiment of the invention in the second mode.

With reference to FIGS. 2A and 2B, when the antenna structure 100 is in a first mode (FIG. 2A), the switch circuit 150 forms an electric path between the second radiator 120 and the second coupling portion 140. When the antenna structure 100 is in a second mode (FIG. 2B), the switch circuit 150 removes the electric path between the second radiator 120 and the second coupling portion 140.

The switch circuit 150 is switched between the first mode and the second mode. When the antenna structure 100 is in the first mode (FIG. 2A), the first coupling portion 121, the second coupling portion 140 and the first end portion 124 are electrically connected together by the switch circuit 150 to form a U-shaped path, and a notch 103 is formed by the U-shaped path, and the first radiator body 112 is partially inserted into the notch 103 to couple to the first coupling portion 121 and the second coupling portion 140 simultaneously. With reference to FIG. 2A, in the first mode, the surface current 101 is fed to the feed portion 111, and travels along the first radiator body 112. A surface current 102 is induced on the first coupling portion 121 and the second coupling portion 140 by coupling the first radiator body 112 with the first coupling portion 121 and the second coupling portion 140, and the surface current 102 travels along the second radiator body 122.

When the antenna structure 100 is in the second mode (FIG. 2B), the second coupling portion 140 is electrically separated from the second radiator body 122, and the first radiator body 112 is only coupled to the first coupling portion 121. With reference to FIG. 2B, in the second mode, the surface 101 is fed at the feed portion 111, and travels along the first radiator body 114. A surface current 102' is induced on the first coupling portion 121 by coupling the first radiator body 112 with the first coupling portion and the surface current 102' travels along the second radiator body 122.

With reference to FIG. 1, in this embodiment, the first radiator 110 further comprises a bending portion 113 utilized to modify the impedance matching of the antenna structure. The feed portion 111 is connected to an end of the bending portion 113, and the first radiator body 112 is connected to the other end of the bending portion 113. In this embodiment, the bending portion is U-shaped, but is not limited thereby. In a modified example, the bending portion 113 can also be omitted, and the feed portion 111 is directly connected to the first radiator body 112.

With reference to FIG. 1, in this embodiment, the ground portion 123 is connected to the second radiator body 122, and is located between the first end portion 124 of the second radiator body 122 and a second end portion 125 of the second radiator body 122. The ground portion 123 is perpendicular to the second radiator body 122. In a modified example, the ground portion 123 is not perpendicular to the second radiator body 122, or has bending structure. The antenna structure 100 can further comprise a ground element 160, wherein the ground portion 123 is connected to the ground element 160, and the ground element 160 is grounded.

With reference to FIG. 1, in this embodiment, the second radiator 120 further comprises an extending portion 126, and the extending portion 126 is connected to the second end portion 125, The extending portion 126 is substantially L-shaped. In modified examples, the shape of the extending portion 126 can be changed, or the extending portion 126 can be omitted.

In the embodiment of the invention, the switch circuit 150 can be formed by a P-intrinsic-N diode (PIN), resister (R) and inductor (L). However, the invention is not limited thereby. The design of the switch circuit 150 can be modified.

Figure 3:
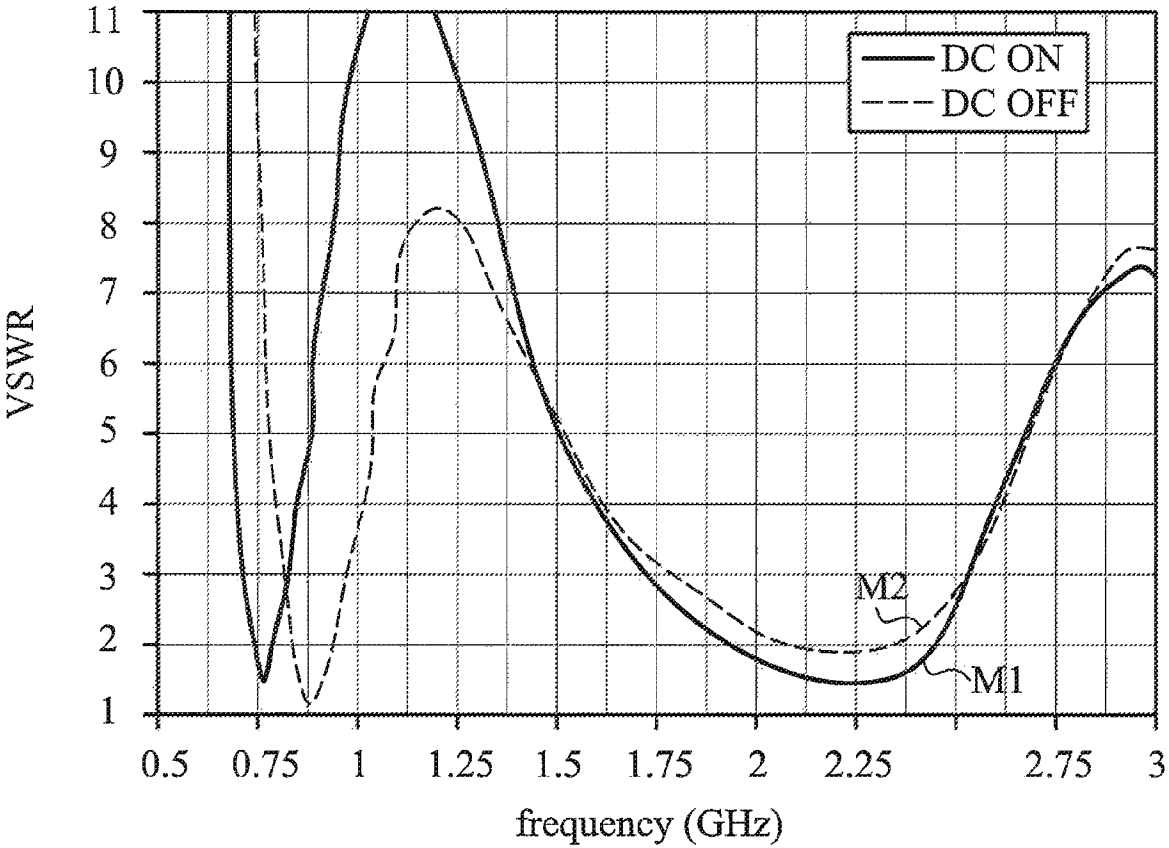
FIG. 3 shows the voltage standing wave ratios of the antenna structure of the embodiment of the invention in the first and second modes.

The antenna structure of the embodiment of the invention is characteristic in that the operation band thereof shifts when the coupling degree between the first radiator 110, the second radiator 120 and the second coupling portion 140 changes to satisfy transmission requirements. FIG. 3 shows the voltage standing wave ratios of the antenna structure of the embodiment of the invention, wherein the line M1 shows the voltage standing wave ratio of the antenna structure in the first mode, and the line M2 shows the voltage standing wave ratio of the antenna structure in the second mode. As shown in FIG. 3, the low-frequency band portion of the antenna structure in the first mode is different from the low-frequency band portion of the antenna structure in the second mode. Therefore, the antenna structure of the embodiment of the invention can satisfy the transmission requirements of different areas (for example, in America or Europe).

Figure 4:
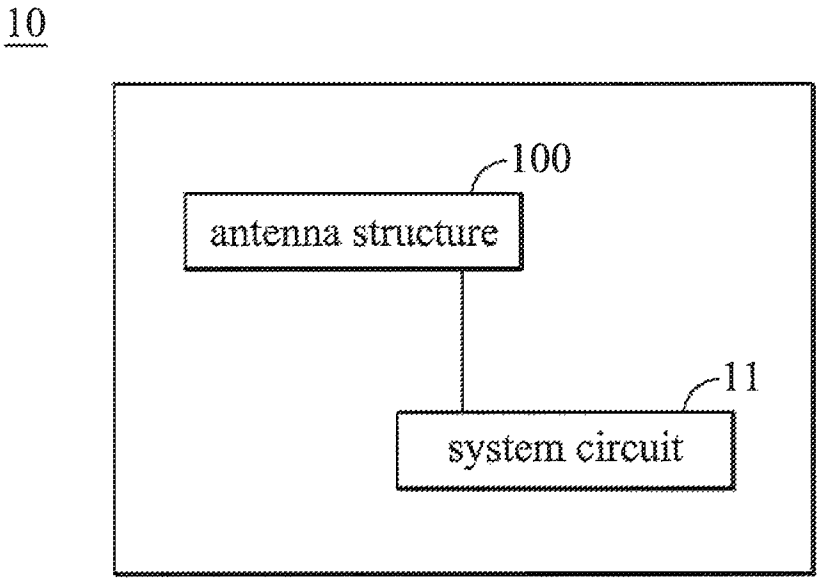
FIG. 4 shows the portable electronic device of the embodiment of the invention.

With reference to FIG. 4, the antenna structure 100 can be utilized in a portable electronic device 10. The portable electronic device 10 comprises the antenna structure 100 and a system circuit 11. The antenna structure 100 is electrically connected to the system circuit 11. When the portable electronic device 10 is activated, the antenna structure 100 sends a high frequency signal to search for wireless network base stations, and the system circuit 11 ascertains the location of the portable electronic device 10 (for example, in America or Europe) according to the detected wireless network base station signal. Then, the antenna structure 100 is switched between the first mode and the second mode according to the location of the portable electronic device 10. The antenna structure can be utilized in notebooks, tablet computers or other electronic devices.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as o encompass all such modifications and similar arrangements.

What is claimed is:

1. An antenna structure, comprising:

a first radiator, comprising a feed portion and a first radiator body;

a second radiator, comprising a first coupling portion, a second radiator body and a ground portion, wherein the first coupling portion is connected to a first end portion of the second radiator body, and the ground portion is connected to the second radiator body;

a second coupling portion, wherein at least a portion of the first radiator body is located between the first coupling portion and the second coupling portion; and a switch circuit, connected to the second radiator and the second coupling portion, wherein when the antenna structure is in a first mode, the switch circuit forms an electric path between the second radiator and the second coupling portion, and when the antenna structure is in a second mode, the switch circuit removes the electric path between the second radiator and the second coupling portion.

2. The antenna structure as claimed in claim 1, wherein the first radiator body is parallel to the first coupling portion and the second coupling portion.

3. The antenna structure as claimed in claim 2, wherein the length of the second coupling portion is shorter than the first radiator body.

4. The antenna structure as claimed in claim 2, wherein when the antenna structure is in the first mode, the first radiator body couples to the first coupling portion and the second coupling portion simultaneously, and when the antenna structure is in the second mode, the first radiator body couples to the first coupling portion.

5. The antenna structure as claimed in claim 4, wherein when the antenna structure is in the first mode, the first coupling portion, the second coupling portion and the first end portion are electrically connected together by the switch circuit to form a U-shaped path, and a notch is formed by the U-shaped path, and the first radiator body is partially inserted into the notch.

6. The antenna structure as claimed in claim 1, wherein the first radiator body further comprises a bending portion, and the feed portion is connected to an end of the bending portion, and the first radiator body is connected to another end of the bending portion.

7. The antenna structure as claimed in claim 6, wherein the bending portion is U-shaped.

8. The antenna structure as claimed in claim 1, wherein the ground portion is connected to the second radiator body, and is located between the first end portion of the second radiator body and a second end portion of the second radiator body.

9. The antenna structure as claimed in claim 8, further comprising a ground element, wherein the ground portion is connected to the ground element,

10. The antenna structure as claimed in claim 8, wherein the second radiator further comprises an extending portion, and the extending portion is connected to the second end portion.

11. A portable electronic device, comprising:

a system circuit; and an antenna structure, electrically connected to the system circuit, comprising:

a first radiator, comprising a feed portion and a first radiator body;

a second radiator, comprising a first coupling portion, a second radiator body and a ground portion, wherein the first coupling portion is connected to a first end portion of the second radiator body, and the ground portion is connected to the second radiator body;

a second coupling portion, wherein at least a portion of the first radiator body is located between the first coupling portion and the second coupling portion; and a switch circuit, connected to the second radiator and the second coupling portion, wherein when the antenna structure is in a first mode, the switch circuit forms an electric path between the second radiator and the second coupling portion, and when the antenna structure is in a second mode, the switch circuit removes the electric path between the second radiator and the second coupling portion.

12. The portable electronic device as claimed in claim 11, wherein the first radiator body is parallel to the first coupling portion and the second coupling portion.

13. The portable electronic device as claimed in claim 12, wherein the length of the second coupling portion is shorter than the first radiator body.

14. The portable electronic device as claimed in claim 12, wherein when the antenna structure is in the first mode, the first radiator body couples to the first coupling portion and the second coupling portion simultaneously, and when the antenna structure is in the second mode, the first radiator body couples to the first coupling portion.

15. The portable electronic device as claimed in claim 14, wherein when the antenna structure is in the first mode, the first coupling portion, the second coupling portion and the first end portion are electrically connected together by the switch circuit to form a U-shaped path, and a notch is formed by the U-shaped path, and the first radiator body is partially inserted into the notch.

* * * * *